US007682264B2

(12) United States Patent
Hsu et al.

(10) Patent No.: US 7,682,264 B2
(45) Date of Patent: Mar. 23, 2010

(54) GOLF CLUB HEAD STRUCTURE

(75) Inventors: Chun-Kai Hsu, Kaohsiung County (TW); Cheng-Tao Lee, Kaohsiung (TW)

(73) Assignee: Advanced International Multitech Co., Ltd, Kaohsiung (TW)

( * ) Notice: Subject to any disclaimer, the term of this patent is extended or adjusted under 35 U.S.C. 154(b) by 184 days.

(21) Appl. No.: 11/984,788

(22) Filed: Nov. 21, 2007

(65) Prior Publication Data

US 2009/0093321 A1 Apr. 9, 2009

(30) Foreign Application Priority Data

Oct. 5, 2007 (TW) ..... 96216722 U

(51) Int. Cl.
*A63B 53/04* (2006.01)

(52) U.S. Cl. ..... 473/342

(58) Field of Classification Search ..... 473/324–350
See application file for complete search history.

(56) References Cited

U.S. PATENT DOCUMENTS

| | | | | |
|---|---|---|---|---|
| 5,228,615 | A * | 7/1993 | Iijima et al. | 228/118 |
| 5,518,240 | A * | 5/1996 | Igarashi | 473/345 |
| 5,522,593 | A * | 6/1996 | Kobayashi et al. | 473/349 |
| 5,547,427 | A * | 8/1996 | Rigal et al. | 473/345 |
| 6,350,209 | B1 * | 2/2002 | Chen | 473/342 |
| 6,524,194 | B2 * | 2/2003 | McCabe | 473/305 |
| 6,679,786 | B2 * | 1/2004 | McCabe | 473/305 |
| 6,749,524 | B1 * | 6/2004 | Chen | 473/342 |
| 6,872,152 | B2 * | 3/2005 | Beach et al. | 473/324 |
| 6,878,073 | B2 * | 4/2005 | Takeda | 473/346 |
| 7,094,159 | B2 * | 8/2006 | Takeda | 473/345 |
| 7,470,201 | B2 * | 12/2008 | Nakahara et al. | 473/345 |

FOREIGN PATENT DOCUMENTS

| | | | |
|---|---|---|---|
| JP | 05317466 | A * | 12/1993 |
| JP | 09099121 | A * | 4/1997 |
| JP | 09248353 | A * | 9/1997 |
| JP | 10015121 | A * | 1/1998 |
| JP | 10015122 | A * | 1/1998 |
| JP | 11313906 | A * | 11/1999 |
| JP | 2002058762 | A * | 2/2002 |
| JP | 2002186695 | A * | 7/2002 |
| JP | 2002369899 | A * | 12/2002 |
| JP | 2003190337 | A * | 7/2003 |
| JP | 2004065853 | A * | 3/2004 |
| JP | 2004097550 | A * | 4/2004 |
| JP | 2005034363 | A * | 2/2005 |

* cited by examiner

*Primary Examiner*—Alvin A Hunter
(74) *Attorney, Agent, or Firm*—Morris, Manning & Martin LLP; Tim Tingkang Xia

(57) ABSTRACT

A golf club head structure includes a body portion, a hitting plate portion, and a club body combining portion. The body portion has a first junction surface forming a first hook angle therewith. The hitting plate portion has a hitting surface and a second junction surface with a buffer region spaced therebetween. The second junction surface forms a second hook angle with the hitting plate portion, and butts against and attaches to the first junction surface on the same plane. The club body combining portion is provided for combining a club body. Therefore, a joint structure with a junction portion as a plane, capable of not being located on the surface of the club head and spaced by a buffer region with the hitting surface, is formed, which is applicable for solving the combination problem of the junction surface on the same plane that the casting is deformed.

12 Claims, 7 Drawing Sheets

GOLF CLUB HEAD STRUCTURE

This application claims the benefit of Taiwan Patent Application No. 096216722, filed on Oct. 5, 2007, which is hereby incorporated by reference for all purposes as if fully set forth herein.

BACKGROUND OF THE INVENTION

1. Field of the Invention

The present invention relates to a combined club head structure of a golf club. More particularly, the present invention relates to a club head structure capable of overcoming the deformation of the assembly part and reducing the hitting impact and stress.

2. Related Art

Conventionally, when the golf club head is fabricated through a casting manner, it is usually formed by combining a plurality of pieces together, and the combining process generally includes a snapping mode and a butting mode. The conventional snapping mode is shown in FIG. 1A, a body joint 11 and a plate joint 13 with corresponding configuration are respectively disposed on the junction portion of a body 10 and the junction portion of a plate 12, so as to be combined into a complete club head 14. As for such a combination manner, once the body or the plate is deformed due to an external factor, such as the problem occurring to the casting process, it is impossible for the two parts to be perfectly fitted with each other, so an additional shaping or complex computer numerical control (CNC) processing and other processes are required to make the two parts be fitted with each other, and thus this combined structure has disadvantages of low yield and time costing.

Referring to FIG. 1B, as for the other conventional combining manner, i.e., the butting mode, a butting surface 16 is mainly disposed on a body 15, so as to be directly soldered with a back surface 18 of a plate 17, and thus forming a club head 19. However, as for the butting mode, the butting surface 16 is quite close to the hitting surface, so the strong hitting impact and deforming stress of the club head 19 all concentrate on the butting surface 16, and thus the welding surface is easily broken.

SUMMARY OF THE INVENTION

In view of the above problems, the present invention is directed to a club head structure, which is capable of enabling components to be fitted together through a simple process even when the components are deformed due to the problem of the casting process, and capable of preventing the impact force and stress generated by the hitting plate from influencing the junction surfaces for the components.

In order to solve the above problem, the technical solution of the present invention is to provide a golf club head structure, which includes a body portion, a hitting plate portion, and a club body combining portion. The body portion has a first junction surface for forming a first hook angle with a surface of the body portion. The hitting plate portion has a hitting surface and a second junction surface with a buffer region existing there-between. The second junction surface forms a second hook angle with a surface of the hitting plate portion, so as to butt against and attach to the first junction surface on the same plane. The club body combining portion is formed on the body portion or the hitting plate portion, for combining a club body.

In the club head structure according to the present invention, the second junction surface is parallel to the hitting surface, so as to bear the maximal hitting impact and stress with the structure itself.

In the club head structure according to the present invention, the body portion and the first junction surface and/or the hitting plate portion and the second junction surface are integrally formed into an extending structure.

In the club head structure according to the present invention, an inner edge of the first junction surface further has a stopper, so as to assist to press against and position an edge of the second junction surface, and/or an inner edge of the second junction surface further has a stopper to assist to press against and position an edge of the first junction surface.

In the club head structure according to the present invention, a junction structure of the first junction surface and the second junction surface is achieved through a brazing mode, a soldering mode, or a bonding mode.

In the club head structure according to the present invention, the golf club head is a wood head, an iron head, or a putter.

Through adopting the technical means of the present invention, the beneficial efficacies achieved are listed as follows. 1. Compared with the conventional snapping mode, when two assembly parts (the body and the plate) are deformed to result in the problem in their combination process, the structure of the present invention only needs a simple milling process to mill the butting surface between the two assembly parts to be flat according to the same angle, so as to perfectly combine them together, which is more preferred when a whole circle of butting surfaces are made on the same plane. Such a structural design of the present invention does not need the conventional shaping or complex CNC processing for making compensations, and thus saving the cost and the processing time, as well as improving the yield. 2. As for the club head structure of the present invention, a certain distance exists between the butting surface and the hitting surface, such that the present invention has a relatively far buffer region compared with the conventional butting structure, so as to reduce the impact force when hitting the ball. Furthermore, since it is relatively far away from the forced region (the butting surface is relatively far away from the hitting surface), the impact stress is relatively low, and the broken problem does not easily occur as well.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

The preferred embodiments of the present invention are described below in detail with reference to the accompanying drawings.

Figure 1A:
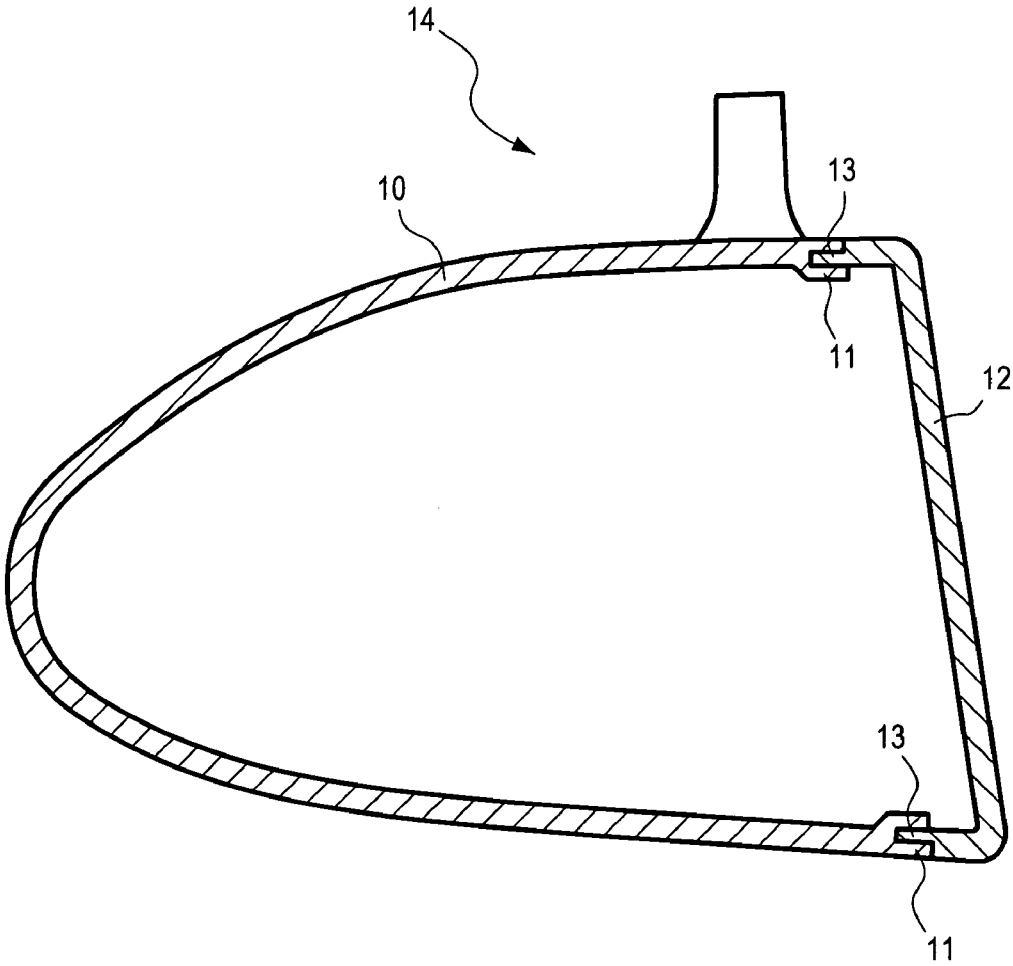
FIG. 1A (PRIOR ART)
FIG. 1A is a schematic cross-sectional view of a snap-in combined club head structure in the conventional art.
Figure 1B:
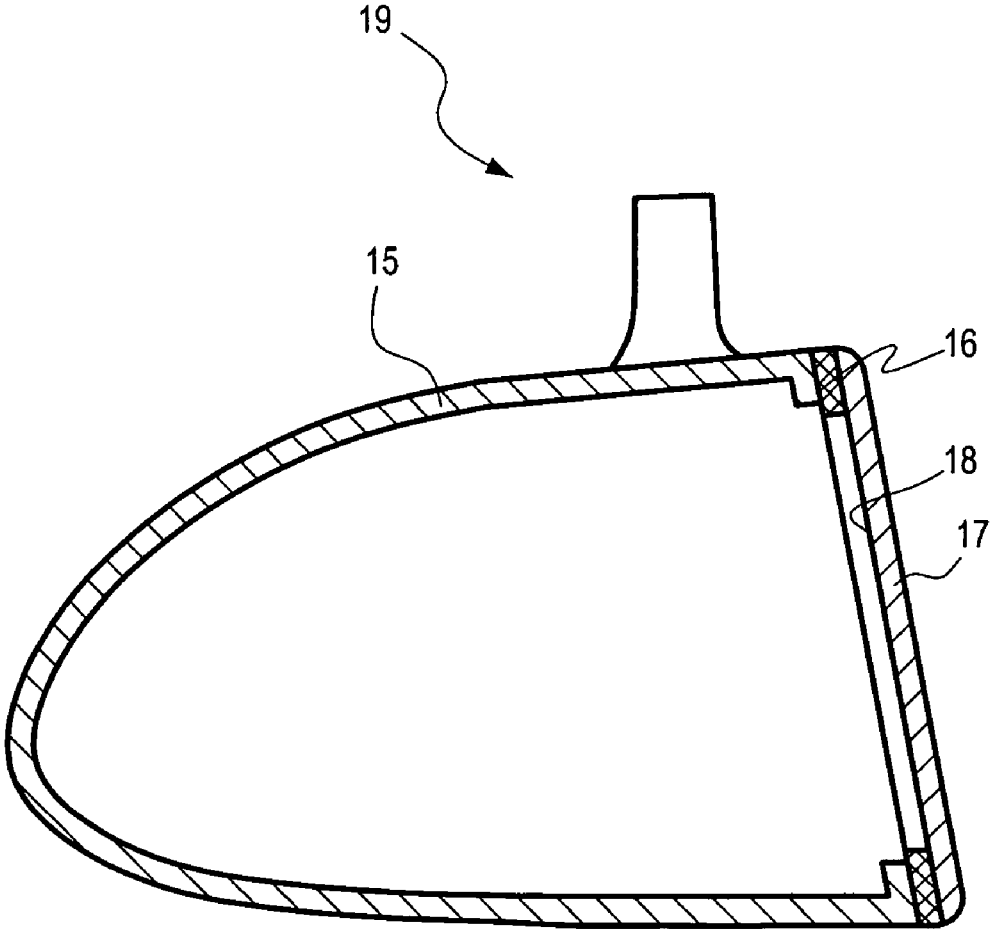
FIG. 1B (PRIOR ART)
FIG. 1B is a schematic cross-sectional view of a butting combined club head structure in the conventional art.
Figure 2A:
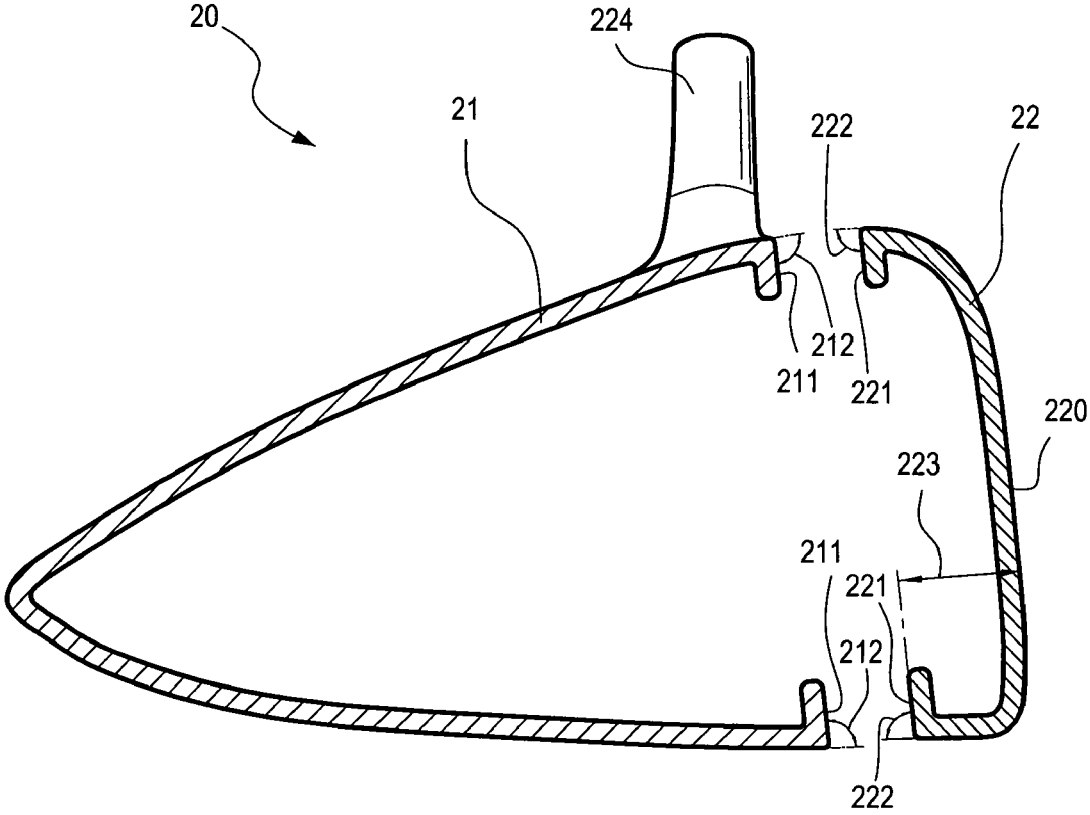
FIG. 2A is an exploded cross-sectional view of a golf club head structure according to one embodiment of the present invention.
Figure 2B:
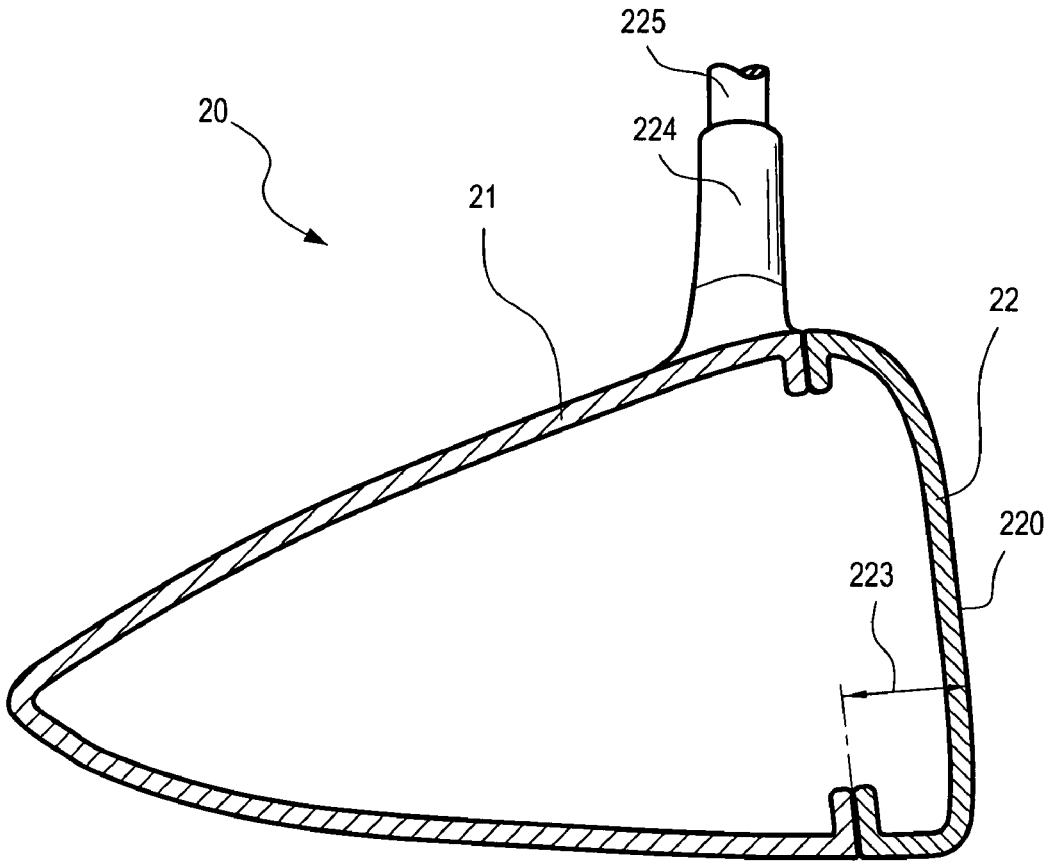
FIG. 2B is a schematic combined cross-sectional view of the golf club head structure according to one embodiment of the present invention.

Referring to FIGS. 2A and 2B, the golf club head structure according to one embodiment of the present invention (in this embodiment, it is a wood head, and other forms such as an iron head and a putter are also suitable for the present invention) includes a casting of a body portion 21, a hitting plate portion 22, and a club body combining portion 224. The body portion 21 has a first junction surface 211 bent from a surface of the body portion 21 (the first junction surface 211 and the body portion 21 may be integrally formed through casting) and forming a first hook angle 212 with the surface of the body portion 21. The hitting plate portion 22 has a hitting surface 220 and a second junction surface 221 with a buffer region 223 existing there-between, and the second junction surface 221 forms a second hook angle 222 with a surface of the hitting plate portion 22 (the second junction surface 221 and the hitting plate portion 22 may be integrally formed through casting, and their material may be same as or different from that of the body portion 21), so as to butt against and attach to the first junction surface 211 on the same plane. The butting structure can be formed through a brazing mode, a soldering mode, or a bonding mode. The club body combining portion 224 is disposed on the body portion 21 (may also be disposed on the hitting plate portion 22 as described below), for combining a club body 225.

Through the above structure, the first junction surface 211 of the body portion 21 and the second junction surface 221 of the hitting plate portion 22 are not located on the surface of the club head 20, and the two junction surfaces are attached to each other on the same plane. Therefore, if the club head 20 or the hitting plate portion 22 is deformed due to the problem of the casting process or other reasons and it is impossible for them to be aligned or combined, the structure of the present invention only needs to further mill the two junction surfaces or one of the junction surfaces according to the same angle to successively perform the combination process. In addition, in the present invention, a buffer region 223 exists between the second junction surface 221 and the hitting surface 220 of the hitting plate portion 22, which is helpful for reducing the strong deforming stress brought by the impact force when hitting the ball, and thus it is not easy for the junction portion to be broken.

In the above structure of the present invention, the first junction surface and the second junction surface are preferably parallel to the hitting surface, so that the structure itself may be sufficiently used to resist the stress of the counter force and to prevent the junction structure from being damaged by the stress, and thus it is not easy for the junction portion to be broken.

Figure 3:
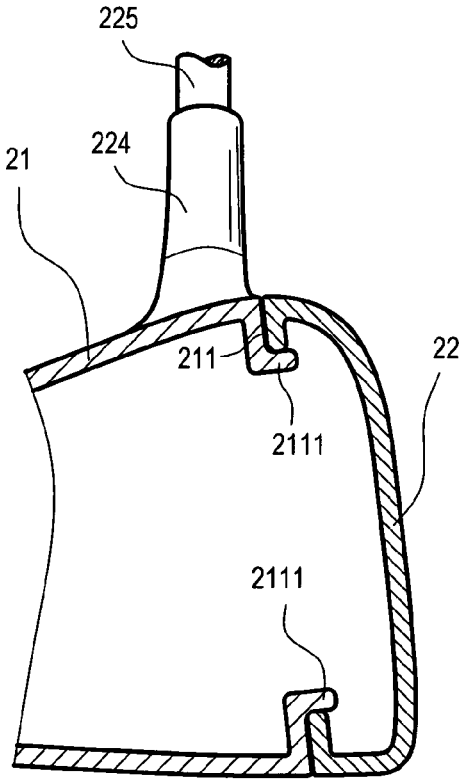
FIG. 3 is a schematic combined cross-sectional view of adding a stopper to the first junction surface of the golf club head structure according to one embodiment of the present invention.
Figure 4:
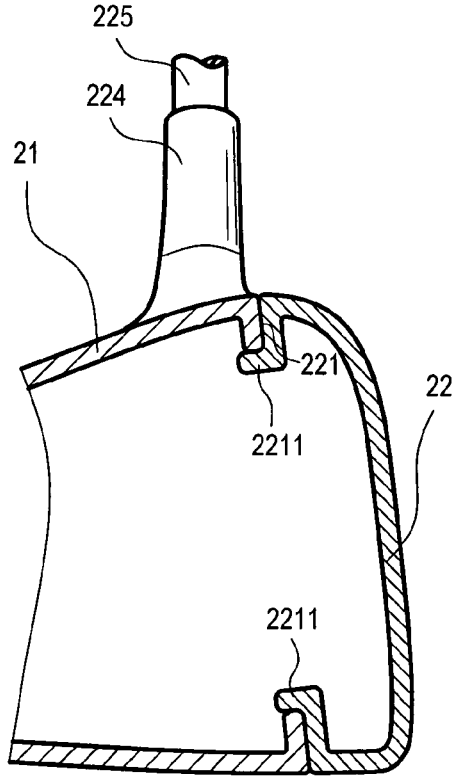
FIG. 4 is schematic combined cross-sectional view of adding a stopper to the second junction surface of the golf club head structure according to one embodiment of the present invention.

Referring to FIGS. 3 and 4, in the above structure of the present invention, an inner edge of the first junction surface 211 further has a stopper 2111, so as to assist to press against and position an outer edge of the second junction surface 221. Definitely, in the above structure of the present invention, an inner edge of the second junction surface 221 further has a stopper 2211, so as to assist to press against and position an outer edge of the first junction surface 211.

Figure 5:
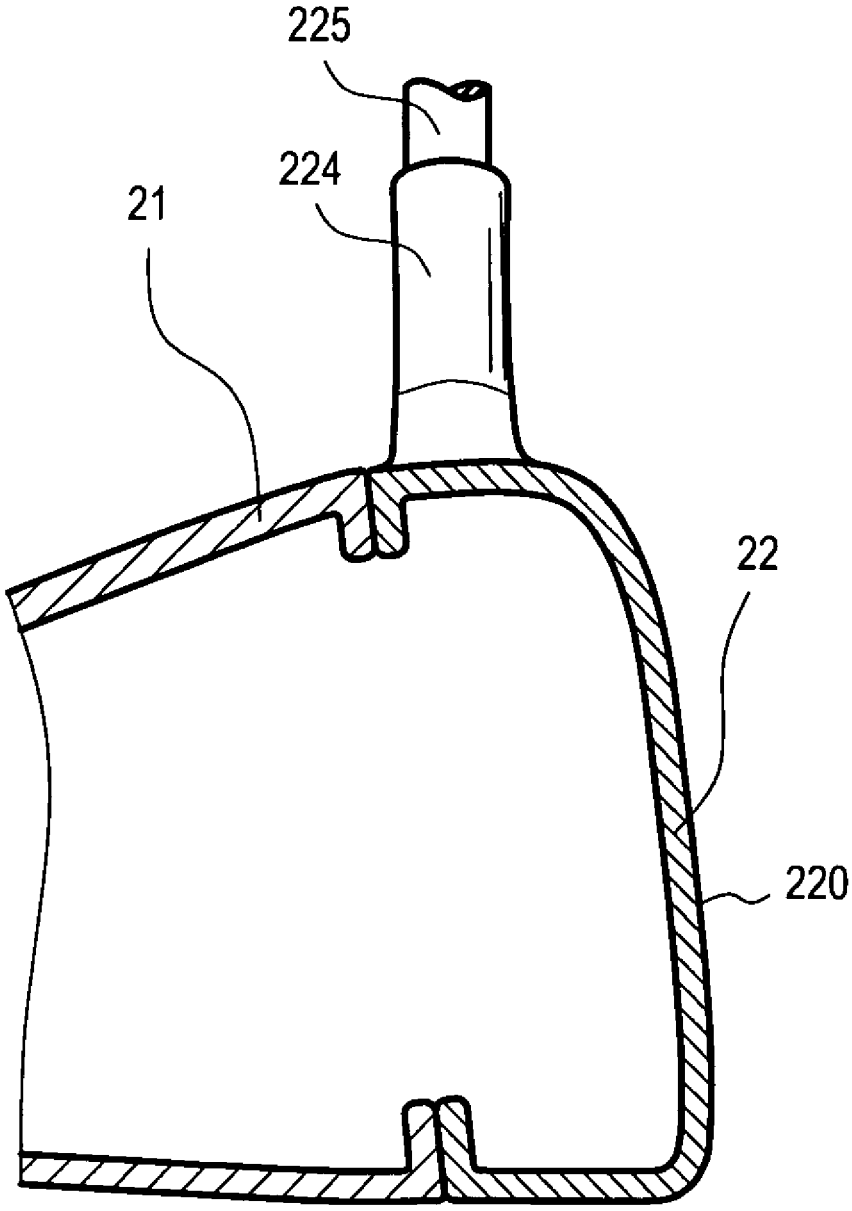
FIG. 5 is a schematic cross-sectional view of forming a club body combining portion on the hitting plate portion to combine the club body in the golf club head structure according to one embodiment of the present invention.
Figure 6:
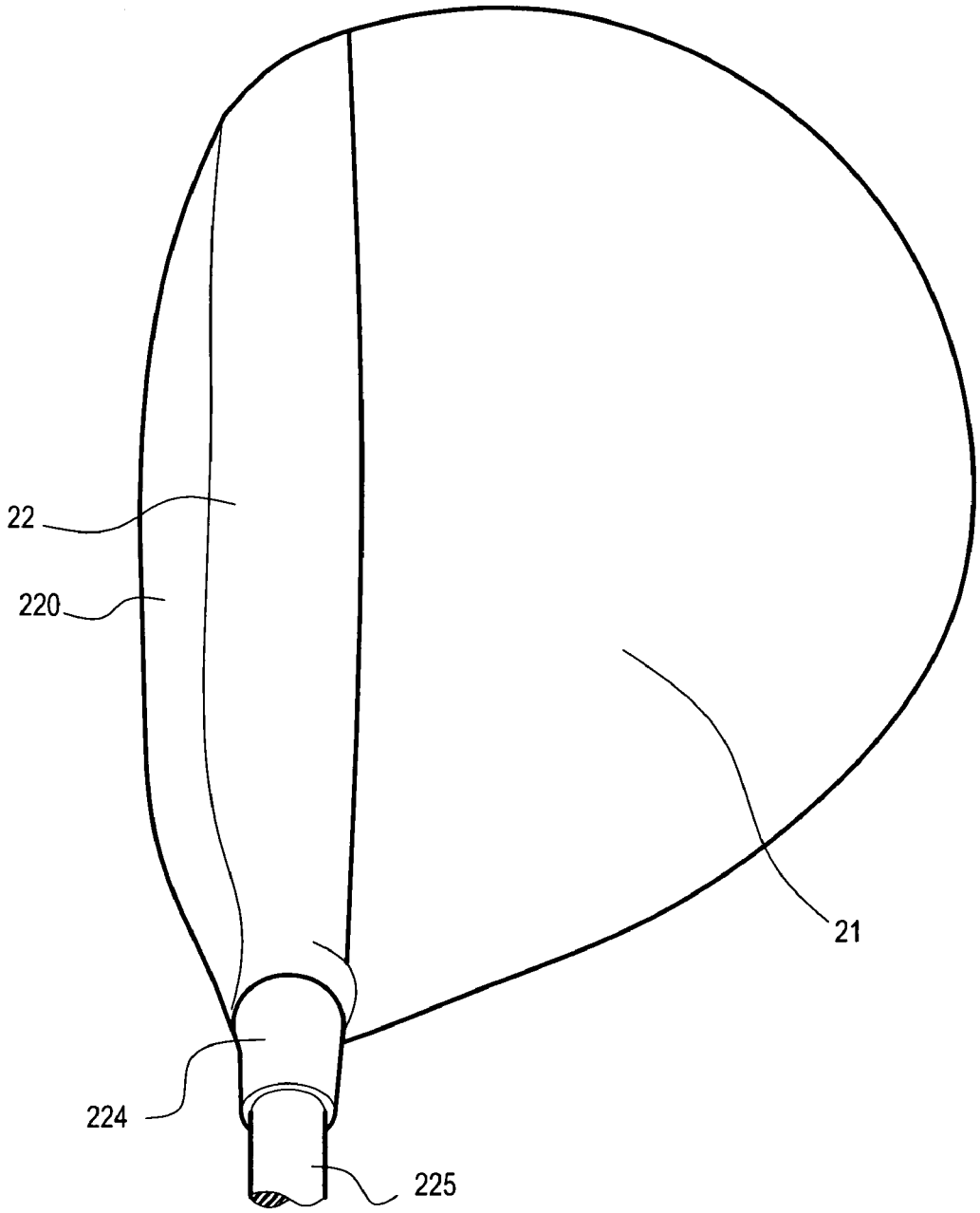
FIG. 6 is a three-dimensional view of forming a club body combining portion on the hitting plate portion to combine the club body in the golf club head structure according to another embodiment of the present invention.

Referring to FIGS. 5 and 6, according to another embodiment of the present invention, the present invention mainly forms a junction structure of the junction surface between the body portion 21 and the hitting plate portion 22, so the club body combining portion 224 for combining the club body 225 is not required to be disposed on the body portion 21, but may be disposed on the hitting plate portion 22 of the hitting surface 220 according to the practical requirements.

Definitely, in the above embodiments, no matter the club body combining portion 224 is disposed on the body portion 21 or on the hitting plate portion 22, the structure may have a long-sleeve neck configuration, a short-sleeve neck configuration, or non-sleeve neck configuration (with sleeve holes disposed therein), so as to further combine with the club body 225.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf club head structure, comprising:

a body portion, having a first junction surface forming a first hook angle with a surface of the body portion;

a hitting plate portion, having a hitting surface and a second junction surface with a buffer region existing there-between, wherein the second junction surface forms a second hook angle with a surface of the hitting plate portion, so as to butt against and attach to the first junction surface on a plane; and a club body combining portion, formed on the body portion or the hitting plate portion, for combining a club body, wherein the first junction surface further has a stopper on an inner edge, so as to assist to press against and to position an outer edge of the second junction surface.

2. The golf club head structure as claimed in claim 1, wherein the first junction surface and the second junction surface are parallel to the hitting surface.

3. The golf club head structure as claimed in claim 1, wherein the body portion and the first junction surface are integrally formed into an extending structure.

4. The golf club head structure as claimed in claim 1, wherein the hitting plate portion and the second junction surface are integrally formed into an extending structure.

5. The golf club head structure as claimed in claim 1, wherein a junction structure of the first junction surface and the second junction surface is achieved through a brazing mode, a soldering mode, or a bonding mode.

6. The golf club head structure as claimed in claim 1, wherein the golf club head is a wood head, an iron head, or a putter.

7. A golf club head structure, comprising:

a body portion, having a first junction surface forming a first hook angle with a surface of the body portion;

a hitting plate portion, having a hitting surface and a second junction surface with a buffer region existing there-between, wherein the second junction surface forms a second hook angle with a surface of the hitting plate portion, so as to butt against and attach to the first junction surface on a plane; and a club body combining portion, formed on the body portion or the hitting plate portion, for combining a club body, wherein the second junction surface further has a stopper on an inner edge, so as to assist to press against and to position an outer edge of the first junction surface.

8. The golf club head structure as claimed in claim 7, wherein the first junction surface and the second junction surface are parallel to the hitting surface.

9. The golf club head structure as claimed in claim 7, wherein the body portion and the first junction surface are integrally formed into an extending structure.

10. The golf club head structure as claimed in claim 7, wherein the hitting plate portion and the second junction surface are integrally formed into an extending structure.

11. The golf club head structure as claimed in claim 7, wherein a junction structure of the first junction surface and the second junction surface is achieved through a brazing mode, a soldering mode, or a bonding mode.

12. The golf club head structure as claimed in claim 7, wherein the golf club head is a wood head, an iron head, or a putter.

* * * * *